US010752419B2

(12) United States Patent
Liao et al.

(10) Patent No.: US 10,752,419 B2
(45) Date of Patent: Aug. 25, 2020

(54) PACKAGING BAG FOR SHOCKPROOF AND COMBINATION THEREOF

(71) Applicant: KUNSHAN AIRBAG PACKING CORP, Kunshan, Suzhou (CN)

(72) Inventors: Kao-Hsiung Liao, Kunshan (CN); Ping-Yuan Liao, Kunshan (CN)

(73) Assignee: KUNSHAN AIRBAG PACKING CORP, Kunshan (CN)

( * ) Notice: Subject to any disclaimer, the term of this patent is extended or adjusted under 35 U.S.C. 154(b) by 0 days.

(21) Appl. No.: 16/538,367

(22) Filed: Aug. 12, 2019

(65) Prior Publication Data

US 2020/0047971 A1 Feb. 13, 2020

(30) Foreign Application Priority Data

Aug. 13, 2018 (TW) ..... 107128237 A

(51) Int. Cl.
*B65D 81/05* (2006.01)
*B65D 33/14* (2006.01)

(52) U.S. Cl.
CPC ..... *B65D 81/052* (2013.01); *B65D 33/14* (2013.01)

(58) Field of Classification Search
CPC ..... B65D 33/14; B65D 33/16; B65D 81/02; B65D 81/03; B65D 81/05; B65D 81/051; B65D 81/052
USPC ..... 206/522
See application file for complete search history.

(56) References Cited

U.S. PATENT DOCUMENTS 8,251,216 B1 * 8/2012 Liao ..... B65D 81/052 206/522
8,770,840 B2 * 7/2014 Liao ..... B65D 81/03 206/522
8,973,756 B2 * 3/2015 Liao ..... B65D 81/022 206/522

* cited by examiner

*Primary Examiner* — Bryon P Gehman
(74) *Attorney, Agent, or Firm* — Rabin & Berdo, P.C.

(57) ABSTRACT

A packaging bag for shockproof includes a bottom wall, a shielding portion, a limiting film and a cover body. Both sides of the shielding portion are adhered to the surface of the bottom wall by heat sealing, and a nesting space is formed between the shielding portion and the bottom wall. The limiting film is stacked above the bottom wall and includes a body and a reversed portion. An accommodation space is formed between a bottom surface of the body, the surface of the bottom wall and the outer longitudinal heat sealing lines, and a limiting space is formed between the top surface of the body, an inner side of the reversed portion and the inner longitudinal heat sealing line. The cover body includes cover air columns located on an upper side of the bottom wall.

17 Claims, 7 Drawing Sheets

PACKAGING BAG FOR SHOCKPROOF AND COMBINATION THEREOF

CROSS-REFERENCE TO RELATED APPLICATION

This non-provisional application claims priority under 35 U.S.C. § 119(a) to Patent Application No. 107128237 filed in Taiwan, R.O.C. on Aug. 13, 2018, the entire contents of which are hereby incorporated by reference.

BACKGROUND OF THE INVENTION

Technical Field

The present invention relates to a packaging bag, and in particular, to a packaging bag having a cushioning and shock-proof function.

Related Art

Logistics transportation is an indispensable field in modern society. With the development of science and technology in recent years, 3C products are changing rapidly. With the dramatic increase of people's consumption demand, the demand for maintenance of electronic products has also increased relatively. Therefore, the number of goods transported for maintenance has also increased considerably compared with the past.

For general maintenance operators, there are packaging materials corresponding to the sizes of the maintenance objects in transportation (for example, on the way back from the dealer to the original factory for maintenance). However, as mentioned above, with the diversity of the sizes of 3C products, the sizes of packaging materials also need to be changed. It is undoubtedly a cost burden for the maintenance operators that a packaging material can only correspond to a size of a product.

In addition, such transport maintenance objects are mostly valuable. Therefore, packaging materials are not only required to be suitable for the sizes of maintenance objects, but also are of great importance to meet the needs of shockproof, cushioning and protection in the transport process.

SUMMARY

Therefore, the present invention provides a packaging bag for shockproof, including a bottom wall, a first shielding portion, a second shielding portion and a limiting film.

The bottom wall includes a plurality of bottom air columns. The first shielding portion includes a plurality of first shielding air columns. The first shielding portion and the bottom wall are integrally connected to an upper side of the bottom wall, and the first shielding portion is folded above a surface of the bottom wall by a first folding line. Both sides of the first shielding portion are adhered to the surface of the bottom wall by means of heat sealing, and a first nesting space is formed between the first shielding portion and the bottom wall. The second shielding portion includes a plurality of second shielding air columns. The second shielding portion and the bottom wall are integrally connected to a lower side of the bottom wall, and the second shielding portion is folded above the surface of the bottom wall by a second folding line. Both sides of the second shielding portion are adhered to the surface of the bottom wall by means of heat sealing, and a second nesting space is formed between the second shielding portion and the bottom wall.

The limiting film is stacked above the bottom wall, including a body and a reversed portion. The reversed portion is located in the second nesting space, and the reversed portion is connected to a bottom end of the body and is folded on a top surface of the body by a folding line. The bottom wall further includes two outer longitudinal heat sealing lines located on both sides of the bottom wall, and the outer longitudinal heat sealing lines separately adhere the reversed portion, the body and an inner wall surface of the second shielding portion to the bottom wall. The reversed portion includes two inner longitudinal heat sealing lines located between the outer longitudinal heat sealing lines, and the reversed portion is adhered to the inner wall surface of the second shielding portion. An accommodation space is formed between a bottom surface of the body, the surface of the bottom wall and the outer longitudinal heat sealing lines, and a limiting space is formed between the top surface of the body, an inner side of the reversed portion and the inner longitudinal heat sealing lines.

According to the foregoing packaging bag for shockproof, in an embodiment, the reversed portion further includes a transverse heat sealing line, and a top side of the reversed portion is adhered to the inner wall surface of the second shielding portion.

According to the foregoing packaging bag for shockproof, in an embodiment, the reversed portion further includes an adhesive part located between the inner longitudinal heat sealing lines, and the reversed portion is adhered to the inner wall surface of the second shielding portion.

According to the foregoing packaging bag for shockproof, in an embodiment, a top end of the body is located between the first shielding portion and the second shielding portion.

According to the foregoing packaging bag for shockproof, in an embodiment, the first shielding portion and the second shielding portion are mirror symmetrical about a transverse centerline of the bottom wall.

According to the foregoing packaging bag for shockproof, in an embodiment, the first shielding portion is adjacent to the second shielding portion.

According to the foregoing packaging bag for shockproof, in an embodiment, a distance exists between the first shielding portion and the second shielding portion.

According to the foregoing packaging bag for shockproof, in an embodiment, the bottom wall includes a hanging hole.

The present invention further provides a packaging bag for shockproof in an embodiment, including a bottom wall, a shielding portion, a limiting film and a cover body.

The bottom wall includes a plurality of bottom air columns. The shielding portion includes a plurality of shielding air columns. The shielding portion is connected to a lower side of the bottom wall and is folded above a surface of the bottom wall by a folding line. Both sides of the shielding portion are adhered to the surface of the bottom wall by means of heat sealing, and a nesting space is formed between the shielding portion and the bottom wall. The limiting film is stacked above the bottom wall, including a body and a reversed portion. The reversed portion is located in the nesting space, and the reversed portion is connected to a bottom end of the body and is folded on a top surface of the body by a folding line. The bottom wall further includes two outer longitudinal heat sealing lines located on both sides of the bottom wall, and the outer longitudinal heat sealing lines separately adhere the reversed portion, the body and an inner wall surface of the shielding portion to the bottom wall. The reversed portion includes two inner longitudinal heat sealing lines located between the outer longitudinal heat sealing lines, and the reversed portion is adhered to the inner wall surface of the shielding portion. An accommodation space is formed between a bottom surface of the body, the surface of the bottom wall and the outer longitudinal heat sealing lines, and a limiting space is formed between the top surface of the body, an inner side of the reversed portion and the inner longitudinal heat sealing lines. The cover body includes a plurality of cover air columns located on an upper side of the bottom wall.

The present invention further provides a combination of packaging bags for shockproof in an embodiment, including the foregoing packaging bag for shockproof and another packaging bag for shockproof. The packaging bags for shockproof are interconnected, and the connection includes a tear line.

According to one or more embodiments described above, a packaging material for shockproof is provided, which can correspond to transportation objects of different sizes. In this way, maintenance operators or transport operators may decide whether to place the transportation objects in the accommodation space or the limiting space depending on the sizes of the transportation objects. In other words, the maintenance operators or the transport operators have more space for selection, thereby reducing the cost of packaging materials in transportation. In addition, the structure of the packaging material for shockproof according to one or more embodiments described above provides multiple cushioning effects, and can be effective in shockproof and protection of transportation objects, thereby solving problems encountered by related art.

DETAILED DESCRIPTION

Figure 1:
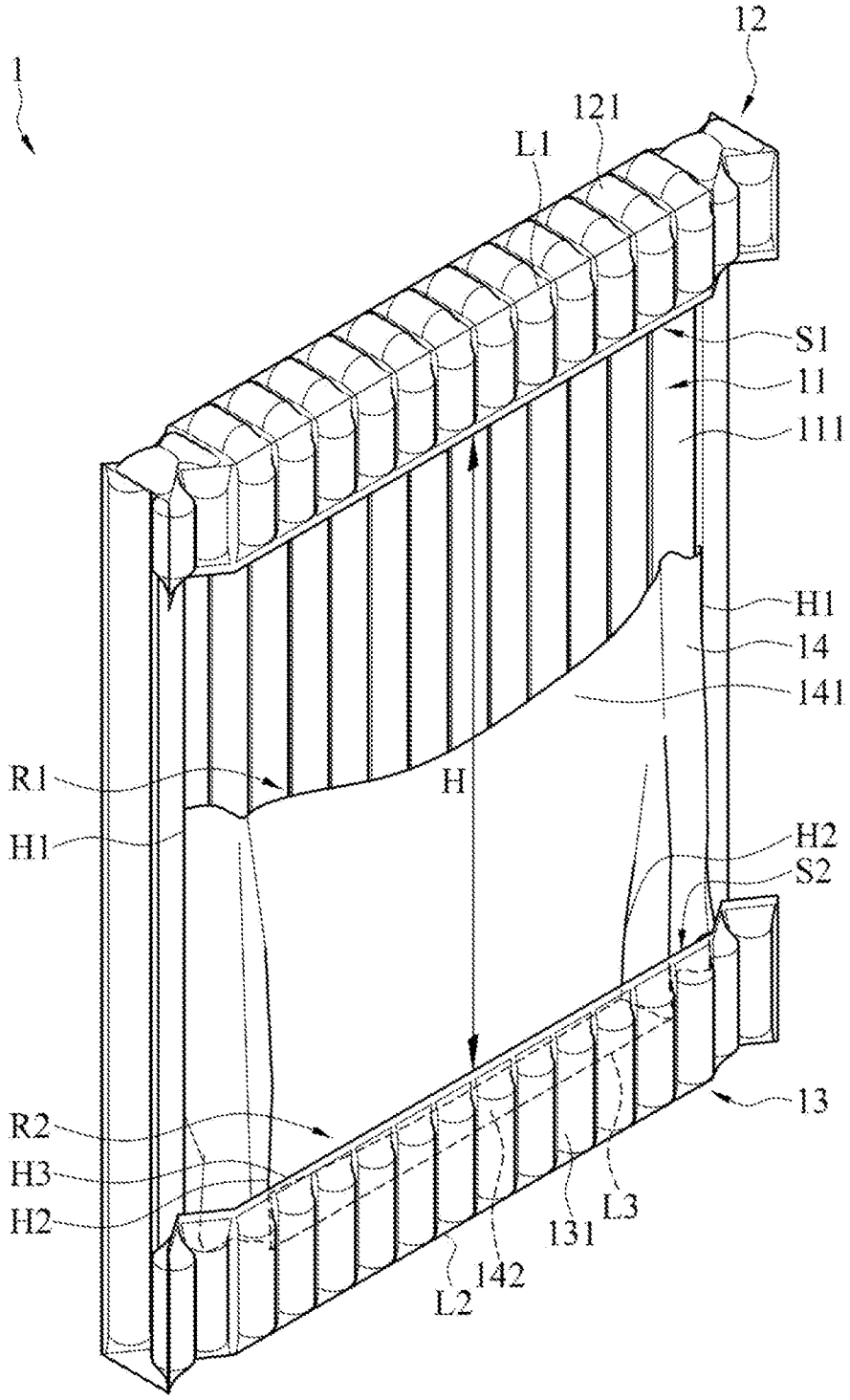
FIG. 1 is a schematic diagram of appearance of a packaging bag for shockproof according to an embodiment of the present invention.
Figure 2:
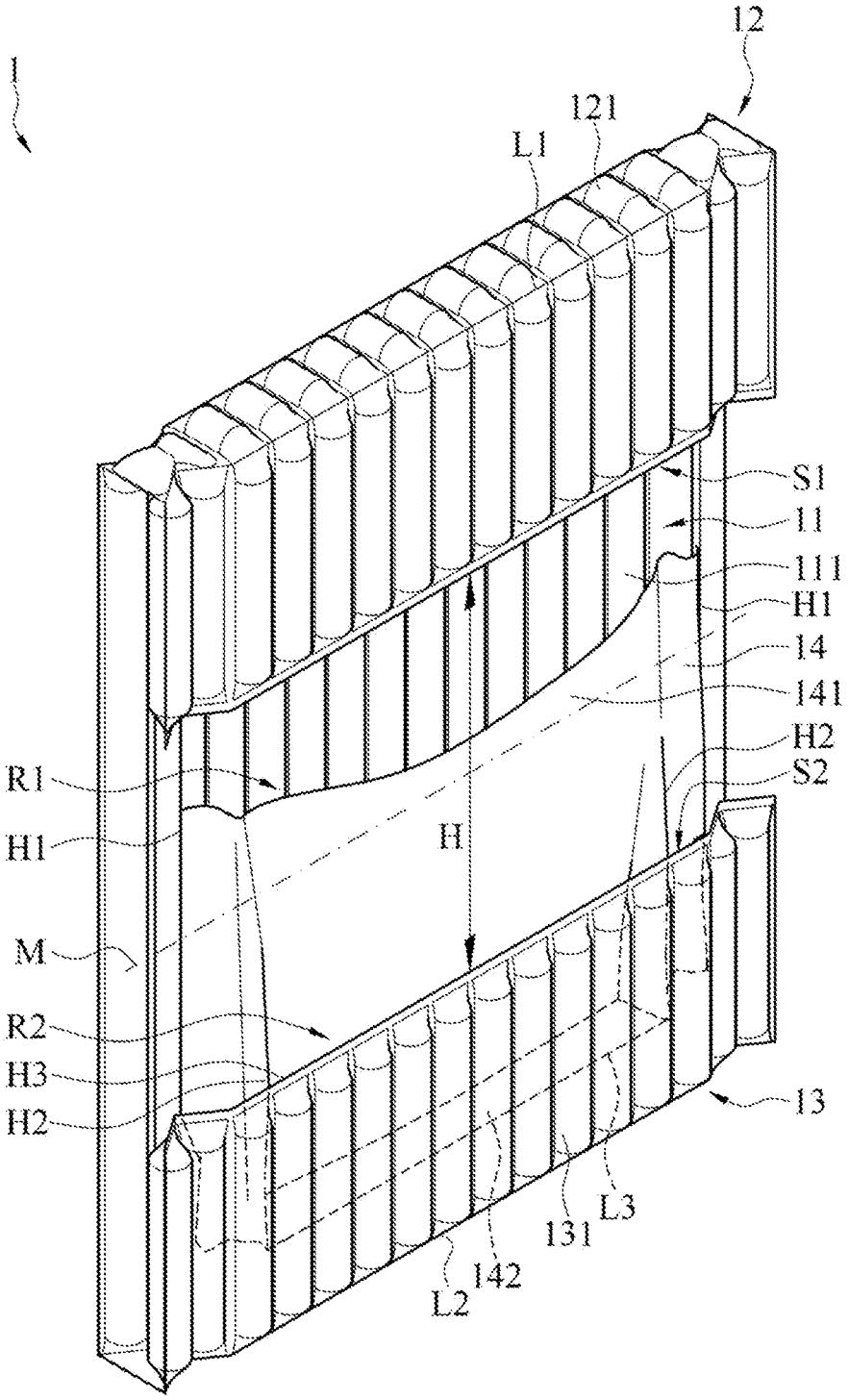
FIG. 2 is a schematic diagram of appearance of a packaging bag for shockproof according to an embodiment of the present invention.
Figure 3:
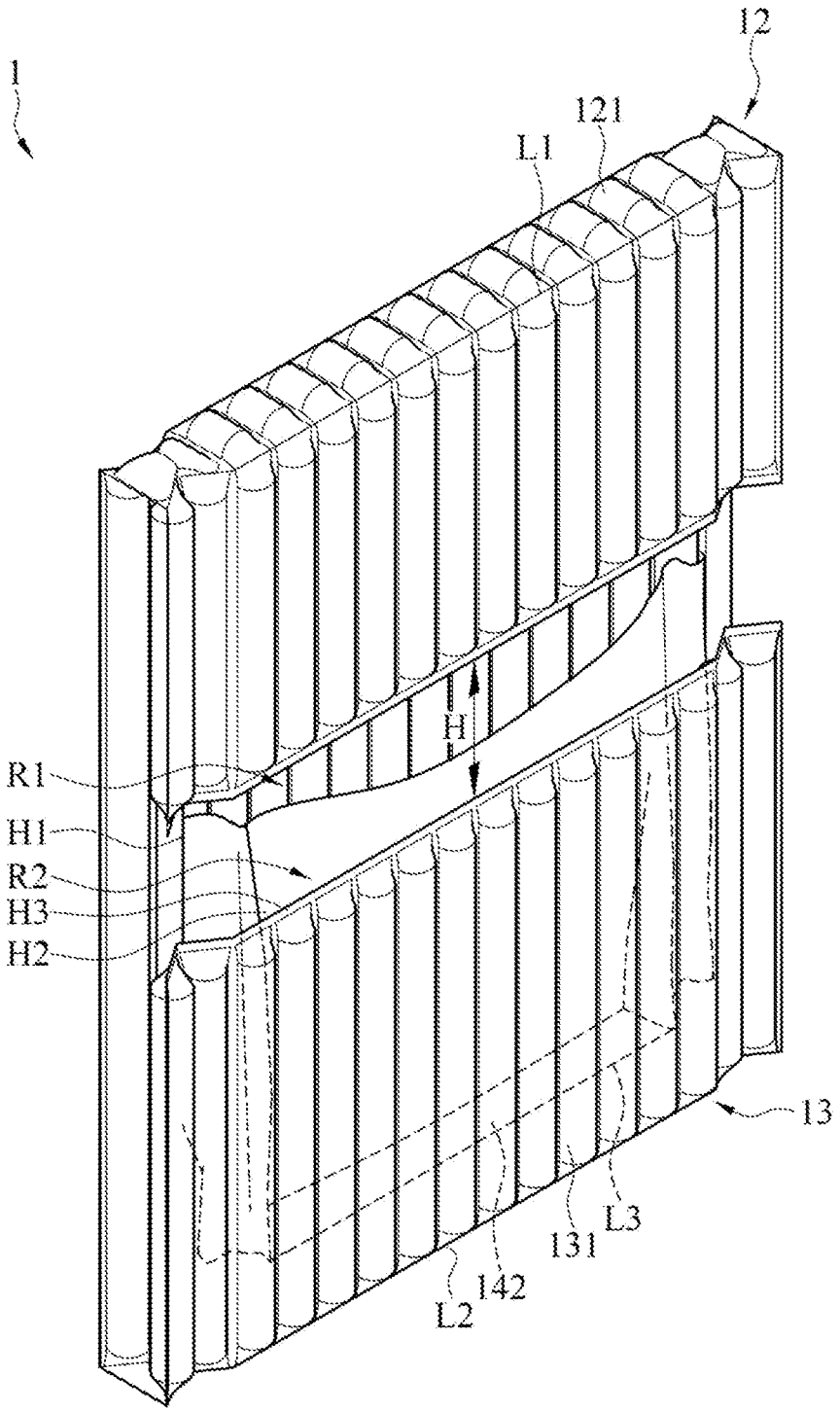
FIG. 3 is a schematic diagram of appearance of a packaging bag for shockproof according to an embodiment of the present invention.
Figure 4:
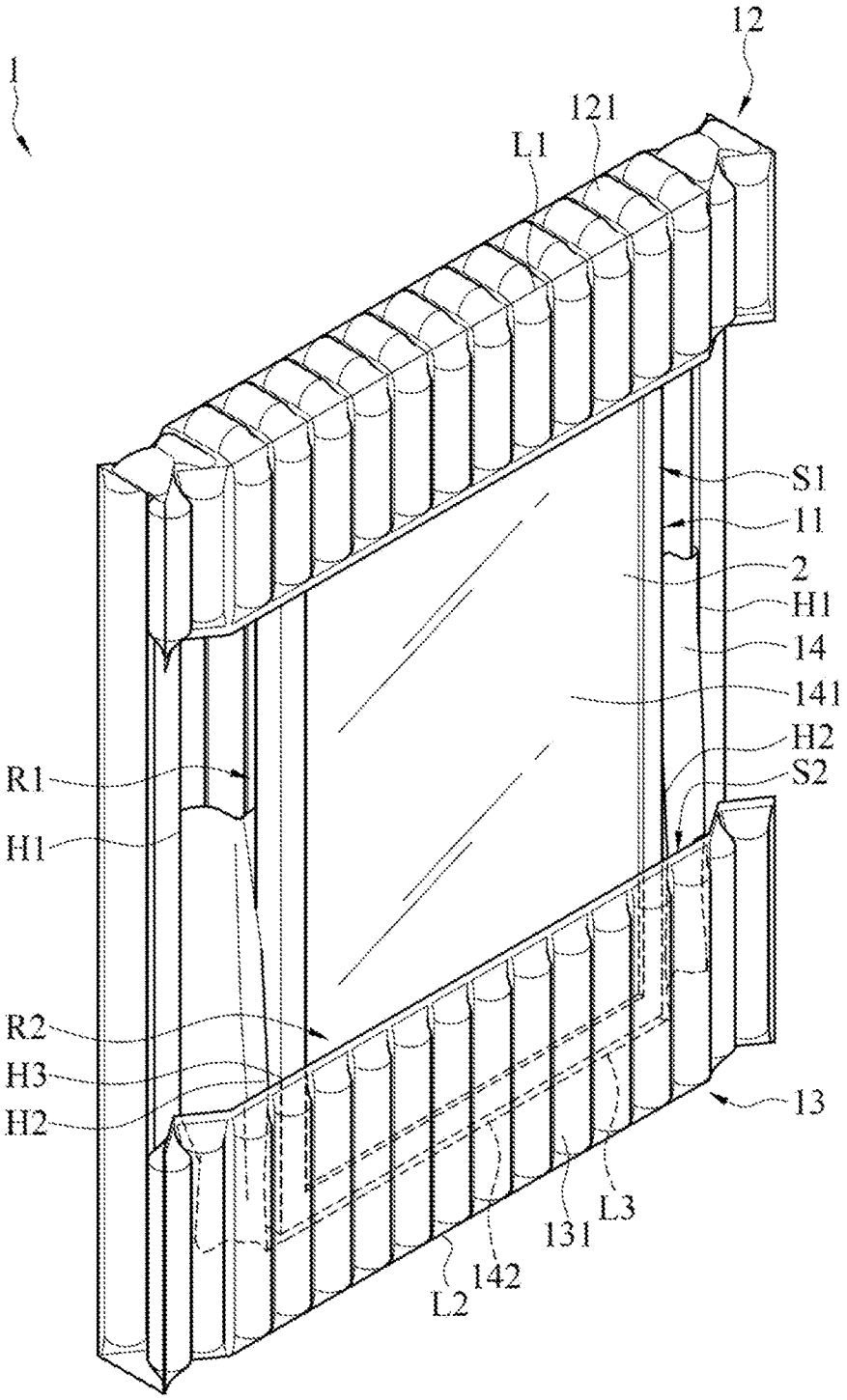
FIG. 4 is a schematic diagram of usage state of a packaging bag for shockproof according to an embodiment of the present invention.
Figure 5:
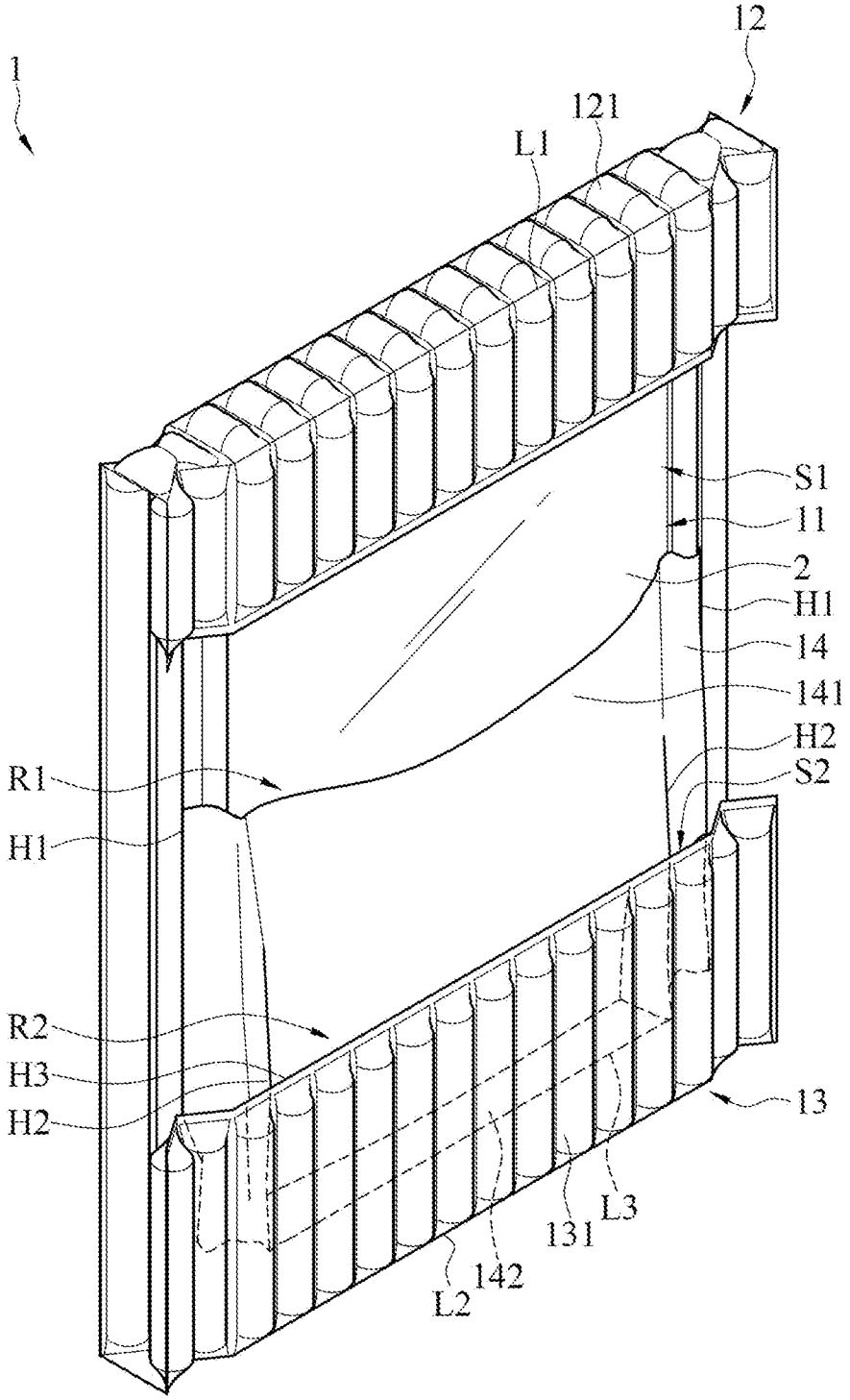
FIG. 5 is a schematic diagram of usage state of a packaging bag for shockproof according to an embodiment of the present invention.

Referring to FIG. 1 to FIG. 5. FIG. 1 to FIG. 3 are respectively schematic diagrams of appearance of a packaging bag 1 for shockproof according to an embodiment of the present invention. FIG. 4 to FIG. 5 are respectively schematic diagrams of usage state of a packaging bag 1 for shockproof according to an embodiment of the present invention. The packaging bag 1 for shockproof includes a bottom wall 11, a first shielding portion 12, a second shielding portion 13 and a limiting film 14.

The bottom wall 11 includes a plurality of bottom air columns 111.

The first shielding portion 12 includes a plurality of first shielding air columns 121. The first shielding portion 12 and the bottom wall 11 are integrally connected to an upper side of the bottom wall 11, and the first shielding portion 12 is folded above a surface of the bottom wall 11 by a first folding line L1. Both sides of the first shielding portion 12 are adhered to the surface of the bottom wall 11 by means of heat sealing, and a first nesting space S1 is formed between the first shielding portion 12 and the bottom wall 11.

The second shielding portion 13 includes a plurality of second shielding air columns 131. The second shielding portion 13 and the bottom wall 11 are integrally connected to a lower side of the bottom wall 11, and the second shielding portion 13 is folded above the surface of the bottom wall 11 by a second folding line L2. Both sides of the second shielding portion 13 are adhered to the surface of the bottom wall 11 by means of heat sealing, and a second nesting space S2 is formed between the second shielding portion 13 and the bottom wall 11.

The first nesting space S1 and the second nesting space S2 can be separately sleeved on a part of a transportation object. For example, in an embodiment, the transportation object is a panel 2. In an embodiment, the bottom wall 11, the first shielding portion 12 and the second shielding portion 13 can be stacked by a plurality of diaphragms by means of heat sealing and inflation.

The limiting film 14 is stacked above the bottom wall 11, that is, between the first shielding portion 12 and the second shielding portion 13, including a body 141 and a reversed portion 142. The reversed portion 142 is located in the second nesting space S2, and the reversed portion 142 is connected to a bottom end of the body 141 and is folded above a top surface of the body 141 by a folding line L3. In other words, the reversed portion 142 is folded by the folding line L3 from a bottom of the limiting film 14.

The bottom wall 11 further includes two outer longitudinal heat sealing lines H1 located on both sides of the bottom wall 11, and the outer longitudinal heat sealing lines separately adhere the reversed portion 142, the body 141 and an inner wall surface of the second shielding portion 13 to the bottom wall 11. The reversed portion 142 includes two inner longitudinal heat sealing lines H2 located between the outer longitudinal heat sealing lines H1, and the reversed portion 142 is adhered to the inner wall surface of the second shielding portion 13. An accommodation space R1 is formed between a bottom surface of the body 141, the surface of the bottom wall 11 and the outer longitudinal heat sealing lines H1, and a limiting space R2 is formed between the top surface of the body 141, an inner side of the reversed portion 142 and the inner longitudinal heat sealing lines H2.

According to the structure of the packaging bag 1 for shockproof, a space for flexible selection is provided for maintenance operators or transport operators. For example, if the size of the transportation object is relatively large, the transportation object is placed in the accommodation space R1. If the size of the transportation object is relatively small, the transportation object is placed in the limiting space R2. In other words, in an embodiment, the packaging bag 1 for shockproof provides at least two sizes of space for the operators to select flexibly. However, the present invention is not limited thereto. In an embodiment, through a plurality of inner longitudinal heat sealing lines H2, a plurality of limiting functions are achieved and a plurality of limiting space R2 are divided to provide more selections for the operators.

In addition, in these embodiments, to further stabilize the limiting film 14 and the limiting space R2, the reversed portion 142 may further include a transverse heat sealing line H3, and a top side of the reversed portion 142 is adhered to the inner wall surface of the second shielding portion 13 to fasten the limiting film 14, as shown in FIG. 1 to FIG. 3.

In addition, in an embodiment, the reversed portion 142 further includes an adhesive part located between the inner longitudinal heat sealing lines H2, and the reversed portion 142 is adhered to the inner wall surface of the second shielding portion 13. For example, the adhesive part is a tape, an adhesive to or a hot sealed node. This structure may further stabilize the limiting film 14, thereby making the limiting space R2 faster and improving cushioning effects.

Further referring to FIG. 1 to FIG. 3, in these embodiments, a top end of the body 141 of the limiting film 14 is located between the first shielding portion 12 and the second shielding portion 13. In some embodiments, the first shielding portion 12 and the second shielding portion 13 separately mask a part of the transportation object. In other words, a distance H exists between the first shielding portion 12 and the second shielding portion 13. In some other embodiments, the first shielding portion 12 is close to or is adjacent to the second shielding portion 13. In other words, in this embodiment, the first shielding portion 12, the second shielding portion 13 and the bottom wall 11 generally cover the whole body of the transportation object. The present invention is not limited thereto, this depends on the needs of the operators or the users.

In some embodiments, the first shielding portion 12 may have a different structure from the second shielding portion 13. A structure with a short longitudinal length of the first shielding portion 12 and a long longitudinal length of the second shielding portion 13 may be adopted to protect the transportation object, or vice versa. In another embodiment, the first shielding portion 12 and the second shielding portion 13 are mirror symmetrical about a transverse centerline M of the bottom wall 11 according to an embodiment shown in FIG. 1.

In an embodiment, the bottom wall 11 of the packaging bag 1 for shockproof includes a hanging hole (not shown in the drawings). This structure may be provided for the operators or the users to hang up the packaging bag 1 for shockproof for storage and display.

Figure 6:
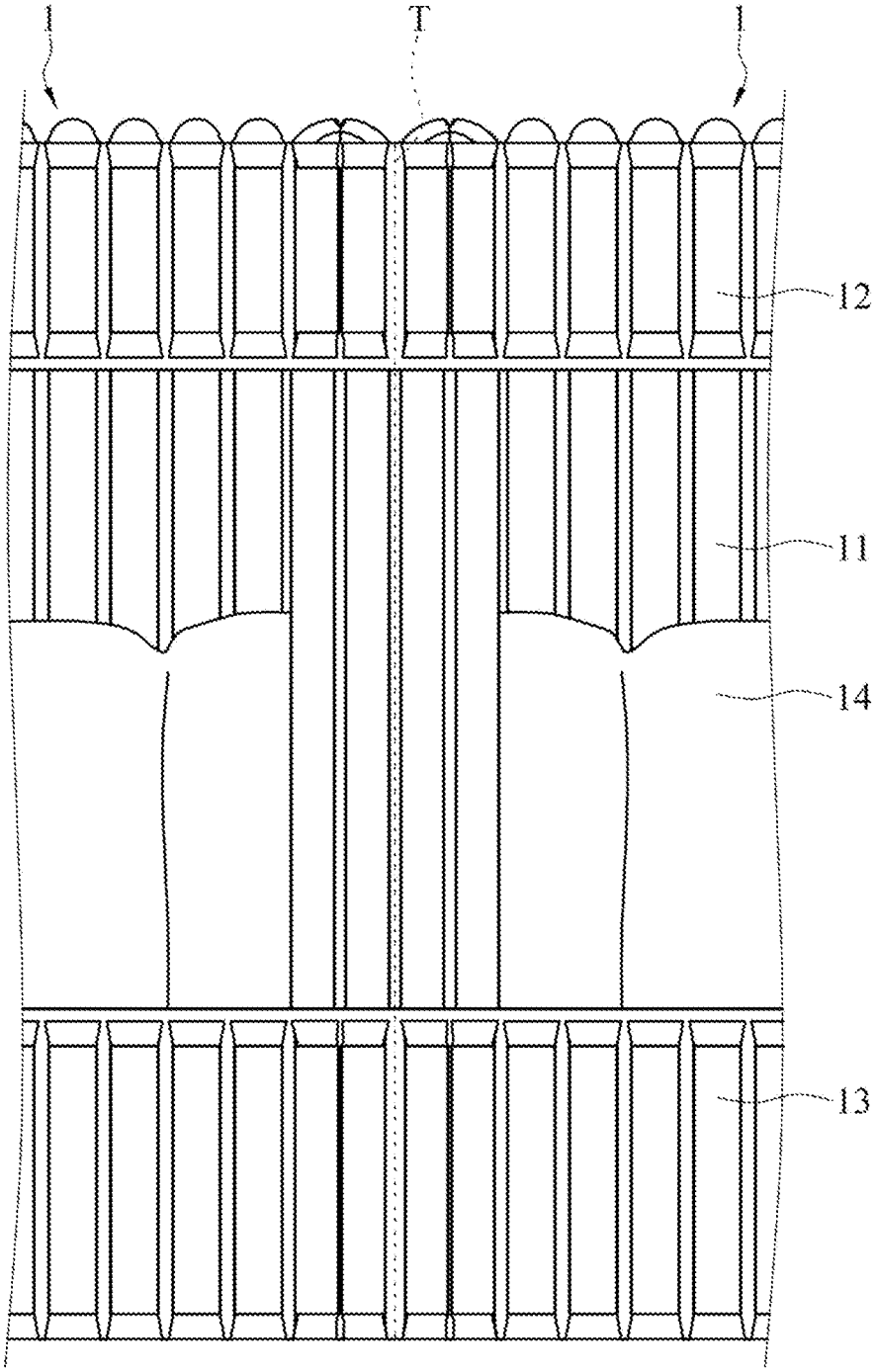
FIG. 6 is a schematic diagram of appearance of a combination of a packaging bags for shockproof according to an embodiment of the present invention.

Referring to FIG. 6, FIG. 6 is a schematic diagram of appearance of a combination of a packaging bags for shockproof 1 according to an embodiment of the present invention. The combination of the packaging bag 1 for shockproof includes the foregoing packaging bag 1 for shockproof and another packaging bag 1 for shockproof. These packaging bags for shockproof 1 are interconnected, and the connection includes a tear line.

In at least one of the foregoing embodiments, the packaging bag 1 for shockproof is composed of the stack of a plurality of diaphragms. Before being inflated, the packaging bag 1 for shockproof can be stored in a stacked manner. In an embodiment, the packaging bags for shockproof 1 can be interconnected to be stored in bundles, and a tear line is included between each other. In this way, the users or the operators can easily tear the packaging bag 1 for shockproof, making the process flow more smoothly. In another embodiment, the limiting film 14 is not pre-arranged on the bottom wall 11, but is stacked for the operators to extract and use.

Figure 7:
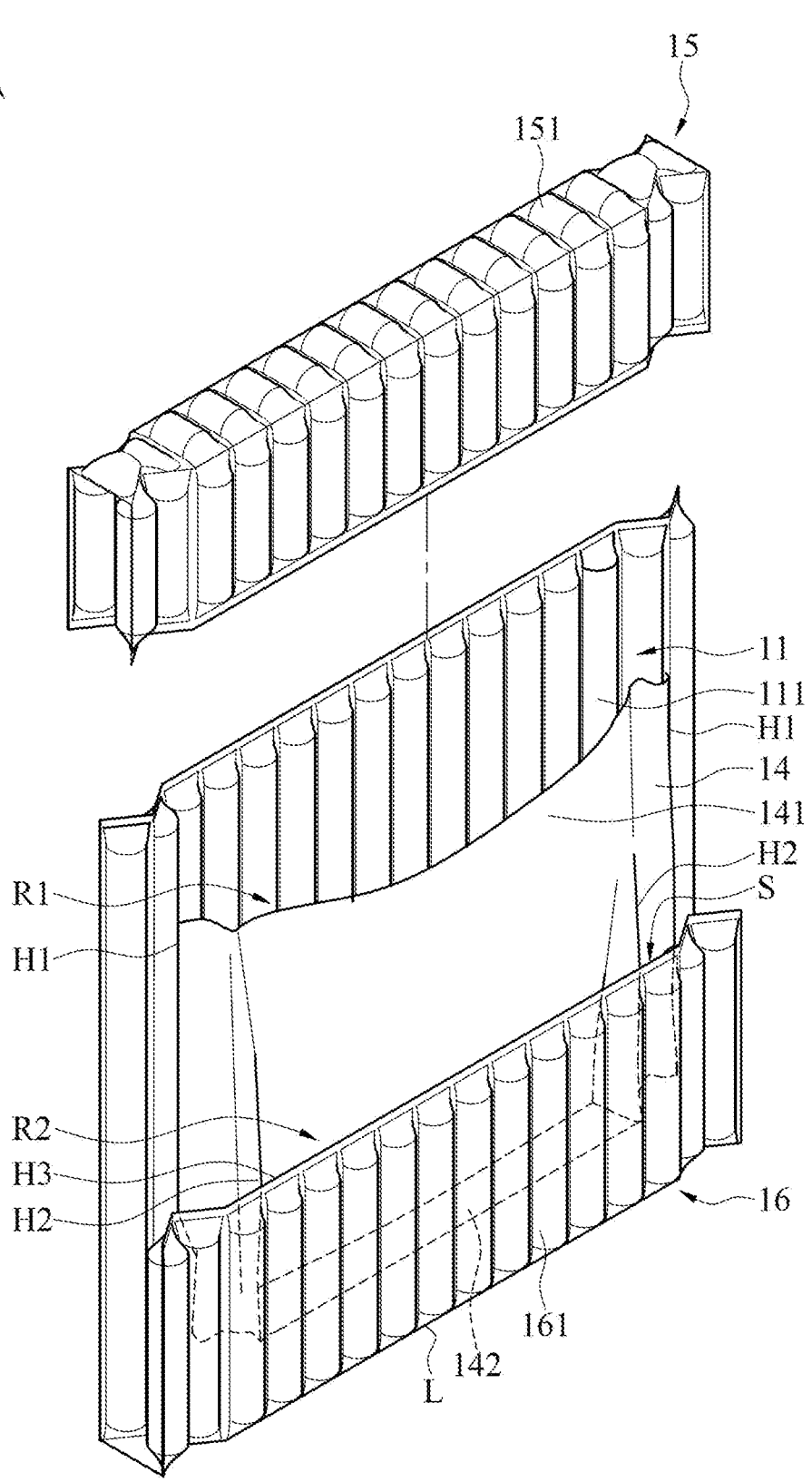
FIG. 7 is a schematic diagram of appearance of a packaging bag for shockproof according to an embodiment of the present invention.

Referring to FIG. 7, FIG. 7 is a schematic diagram of appearance of a packaging bag 1 for shockproof according to an embodiment of the present invention. The packaging bag 1 for shockproof includes a bottom wall 11, a shielding portion 16, a limiting film 14 and a cover body 15.

The bottom wall 11 includes a plurality of bottom air columns 111.

The shielding portion 16 includes a plurality of shielding air columns 161. The shielding portion 16 is connected to a lower side of the bottom wall 11 and is folded above a surface of the bottom wall 11 by a folding line L. Both sides of the shielding portion 16 are adhered to the surface of the bottom wall 11 by means of heat sealing, and a nesting space S is formed between the shielding portion 16 and the bottom wall 11.

The limiting film 14 is stacked above the bottom wall 11, including a body 141 and a reversed portion 142. The reversed portion 142 is located in the nesting space, and the reversed portion 142 is connected to a bottom end of the body 141 and is folded above a top surface of the body 141 by a folding line L. The bottom wall 11 further includes two outer longitudinal heat sealing lines H1 located on both sides of the bottom wall 11, and the outer longitudinal heat sealing lines H1 separately adhere the reversed portion 142, the body 141 and an inner wall surface of the shielding portion 16 to the bottom wall 11. The reversed portion 142 includes two inner longitudinal heat sealing lines H2 located between the outer longitudinal heat sealing lines H1, and the reversed portion 142 is adhered to the inner wall surface of the shielding portion 16. An accommodation space R1 is formed between a bottom surface of the body 141, the surface of the bottom wall 11 and the outer longitudinal heat sealing lines H1, and a limiting space R2 is formed between the top surface of the body 141, an inner side of the reversed portion 142 and the inner longitudinal heat sealing lines H2. The cover body 15 includes a plurality of cover air columns 151 located on an upper side of the bottom wall 11.

Different from the embodiments shown in FIG. 1 to FIG. 3, in this embodiment, the bottom wall 11 and the shielding portion 16 are connected to form a part, and the cover body 15 is another part. In other words, the present invention is not limited to that a transportation object packaged in the packaging bag 1 for shockproof needs to be packaged in a whole structure. In the embodiment shown in FIG. 6, the packaging bag 1 for shockproof may alternatively be disassembled into two parts to be sleeved on the transportation object. Similarly, this embodiment provides the accommodation space R1 and the limiting space R2 for the users and the operators to use flexibly. For descriptions of the accommodation space R1 and the limiting space R2, refer to the foregoing embodiments, and details are not described herein again.

According to the one or more embodiments described above, a packaging material for shockproof is provided, which can correspond to transportation objects of different sizes. In this way, maintenance operators or transport operators may decide whether to place the transportation objects in the accommodation space or the limiting space depending on the sizes of the transportation objects. In other words, the maintenance operators or the transport operators have a relatively large space for selection, thereby reducing the cost of packaging materials in transportation.

In addition, the structure of the packaging material for shockproof according to the one or more embodiments described above, the limiting film and the inflatable air columns provide multiple cushioning effects, and can be effective in shockproof and protection of transportation objects.

What is claimed is:

1. A packaging bag for shockproof, comprising:

a bottom wall, comprising a plurality of bottom air columns;

a first shielding portion, comprising a plurality of first shielding air columns, wherein the first shielding portion is integrally connected to an upper side of the bottom wall, and is folded above a surface of the bottom wall along a first folding line, on both sides of the first folding line, the first shielding portion is adhered to the bottom wall by means of heat sealing, and a first nesting space is formed between the first shielding portion and the bottom wall;

a second shielding portion, comprising a plurality of second shielding air columns, wherein the second shielding portion is integrally connected to a lower side of the bottom wall, and is folded above the surface of the bottom wall along a second folding line, on both sides of the second folding line, the second shielding portion is adhered to the bottom wall by means of the heat sealing, and a second nesting space is formed between the second shielding portion and the bottom wall; and a limiting film, stacked above the bottom wall, comprising:

a body, and a reversed portion, located in the second nesting space, wherein the reversed portion is connected to a bottom end of the body and is folded on a top surface of the body along a folding line, the bottom wall further comprises two outer longitudinal heat sealing lines respectively located on two opposite sides of the bottom wall in a lateral direction, the outer longitudinal heat sealing lines separately adhering the reversed portion, the body and an inner wall surface of the second shielding portion to the bottom wall, the reversed portion comprises two inner longitudinal heat sealing lines located between the outer longitudinal heat sealing lines, adhering the reversed portion to the inner wall surface of the second shielding portion, an accommodation space is formed between a bottom surface of the body, the surface of the bottom wall and the outer longitudinal heat sealing lines, and a limiting space is formed between the top surface of the body, an inner side of the reversed portion and the inner longitudinal heat sealing lines.

2. The packaging bag for shockproof according to claim 1, wherein the reversed portion further comprises a transverse heat sealing line, adhering a top side of the reversed portion to the inner wall surface of the second shielding portion.

3. The packaging bag for shockproof according to claim 1, wherein the reversed portion further comprises an adhesive part that is located between the inner longitudinal heat sealing lines, and through which the reversed portion is adhered to the inner wall surface of the second shielding portion.

4. The packaging bag for shockproof according to claim 1, wherein a top end of the body is located between the first shielding portion and the second shielding portion.

5. The packaging bag for shockproof according to claim 1, wherein the first shielding portion and the second shielding portion are in mirror symmetry with respect to a transverse centerline of the bottom wall.

6. The packaging bag for shockproof according to claim 1, wherein the first shielding portion is adjacent to the second shielding portion.

7. The packaging bag for shockproof according to claim 1, wherein the first shielding portion and the second shielding portion are spaced apart from each other.

8. The packaging bag for shockproof according to claim 1, wherein the bottom wall comprises a hanging hole.

9. A combination of packaging bags for shockproof, comprising the packaging bag for shockproof according to claim 1 and another packaging bag for shockproof, wherein the packaging bags for shockproof are interconnected, and the connection comprises a tear line.

10. The combination of packaging bags for shockproof according to claim 9, wherein the reversed portion further comprises a transverse heat sealing line, adhering a top side of the reversed portion to the inner wall surface of the second shielding portion.

11. The combination of packaging bags for shockproof according to claim 9, wherein the reversed portion further comprises an adhesive part that is located between the inner longitudinal heat sealing lines, and through which the reversed portion is adhered to the inner wall surface of the second shielding portion.

12. The combination of packaging bags for shockproof according to claim 9, wherein a top end of the body is located between the first shielding portion and the second shielding portion.

13. The combination of packaging bags for shockproof according to claim 9, wherein the first shielding portion and the second shielding portion are in mirror symmetry with respect to a transverse centerline of the bottom wall.

14. The combination of packaging bags for shockproof according to claim 9, wherein the first shielding portion is adjacent to the second shielding portion.

15. The combination of packaging bags for shockproof according to claim 9, wherein a first shielding portion and the second shielding portion are spaced apart from each other.

16. The combination of packaging bags for shockproof according to claim 9, wherein the bottom wall comprises a hanging hole.

17. A packaging bag for shockproof, comprising:

a bottom wall, comprising a plurality of bottom air columns;

a shielding portion, comprising a plurality of shielding air columns, wherein the shielding portion is connected to a lower side of the bottom wall and is folded above a surface of the bottom wall along a folding line, on both sides of the folding line, the shielding portion is adhered to the bottom wall by means of heat sealing, and a nesting space is formed between the shielding portion and the bottom wall;

a limiting film, stacked above the bottom wall, comprising:

a body, and a reversed portion, located in the nesting space, wherein the reversed portion is connected to a bottom end of the body and is folded on a top surface of the body along a folding line, the bottom wall further comprises two outer longitudinal heat sealing lines located on two opposite sides of the bottom wall in a lateral direction, the outer longitudinal heat sealing lines separately adhering the reversed portion, the body and an inner wall surface of the shielding portion to the bottom wall, the reversed portion comprises two inner longitudinal heat sealing lines located between the outer longitudinal heat sealing lines, adhering the reversed portion to the inner wall surface of the shielding portion, an accommodation space is formed between a bottom surface of the body, the surface of the bottom wall and the outer longitudinal heat sealing lines, and a limiting space is formed between the top surface of the body, an inner side of the reversed portion and the inner longitudinal heat sealing lines; and a cover body, comprising a plurality of cover air columns located on an upper side of the bottom wall.

* * * * *